US009466890B2

(12) United States Patent
Hanaoka

(10) Patent No.: US 9,466,890 B2
(45) Date of Patent: Oct. 11, 2016

(54) SWITCH DEVICE

(71) Applicant: Toyo Denso Co. Ltd., Tokyo (JP)

(72) Inventor: Yoshimitsu Hanaoka, Tsurugashima (JP)

(73) Assignee: TOYO DENSO CO., LTD., Tokyo (JP)

( * ) Notice: Subject to any disclaimer, the term of this patent is extended or adjusted under 35 U.S.C. 154(b) by 29 days.

(21) Appl. No.: 14/174,495

(22) Filed: Feb. 6, 2014

(65) Prior Publication Data

US 2014/0224631 A1 Aug. 14, 2014

(30) Foreign Application Priority Data

Feb. 13, 2013 (JP) ..... 2013-025217

(51) Int. Cl.

| | |
|---|---|
| ***H01H 13/14*** | (2006.01) |
| ***H01Q 23/00*** | (2006.01) |
| ***H01H 13/52*** | (2006.01) |
| *H01H 13/02* | (2006.01) |

(52) U.S. Cl.

CPC ..... *H01Q 23/00* (2013.01); *H01H 13/52* (2013.01); *H01H 2013/026* (2013.01); *H01H 2219/062* (2013.01); *H01H 2219/064* (2013.01)

(58) Field of Classification Search

CPC ..... H01H 2300/032; H01H 2219/062
USPC ..... 200/341, 314
See application file for complete search history.

(56) References Cited

U.S. PATENT DOCUMENTS

| | | | | |
|---|---|---|---|---|
| 6,777,633 | B2 * | 8/2004 | Kondo et al. | 200/310 |
| 2012/0075063 | A1 | 3/2012 | Sakamoto et al. | |
| 2012/0199461 | A1 | 8/2012 | Shim et al. | |

FOREIGN PATENT DOCUMENTS

| | | |
|---|---|---|
| JP | 07-129867 | 5/1995 |
| JP | 2007-129867 | 5/1995 |
| JP | 2002-231093 | 8/2002 |
| JP | 2007-287437 | 11/2007 |
| JP | 2010-213081 | 9/2010 |
| JP | 2011-060626 | 3/2011 |
| JP | 2011-124030 | 6/2011 |
| JP | 2011-204508 | 10/2011 |
| WO | 2014/017324 | 1/2014 |

OTHER PUBLICATIONS

European Search Report for European Application No. 14154004.7 dated May 27, 2014.
Japanese Office Action Application No. 2013-025217 mailed Jan. 20, 2015.

* cited by examiner

*Primary Examiner* — Renee Luebke
*Assistant Examiner* — Ahmed Saeed
(74) *Attorney, Agent, or Firm* — Steptoe & Johnson LLP

(57) ABSTRACT

A switch device includes a circuit board disposed in a tubular holder case, a control button disposed for movement along the longitudinal directions of the holder case, the control button being actuated by pressing from outside of the switch device, and a switch unit mounted on the circuit board, the switch unit being actuated in response to rearward movement of the control button by pressing. A coil antenna is disposed rearwardly of the control button and has an outside diameter which is substantially the same as an outside diameter of the control button.

10 Claims, 12 Drawing Sheets

SWITCH DEVICE

CROSS-REFERENCE TO RELATED APPLICATION

This application is based upon and claims the benefit of priority from Japanese Patent Application No. 2013-025217 filed on Feb. 13, 2013, the contents of which are incorporated herein by reference.

BACKGROUND OF THE INVENTION

1. Field of the Invention

The present invention relates to a switch device having a coil antenna for emitting a radio wave for energizing an external portable device.

2. Description of the Related Art

In recent years, there has been used in the art a smart ignition system for making the engine on a vehicle ready to start when the driver of the vehicle presses the control button of an engine starter switch (switch device) of the vehicle providing that a portable device carried by the driver and the vehicle have their ID information agreeing with each other upon communication with each other.

Usually, such a switch device has a coil antenna for performing wireless power feeding on the portable device. If the portable device fails to check the ID information against the vehicle due to a cell power failure, then the coil antenna induces an electromotive force in a transponder of the portable device that is held in the vicinity of the control button.

For example, Japanese Laid-Open Patent Publication No. 2011-060626 discloses a switch device having a coil antenna which is disposed inside or behind a control button and whose outside diameter is smaller than the inside diameter of the control button.

SUMMARY OF THE INVENTION

According to the switch device disclosed in Japanese Laid-Open Patent Publication No. 2011-060626, since the outside diameter of the coil antenna is smaller than the outside diameter of the control button, the switch device is prevented from increasing in size radially of the coil antenna. However, the intensity of the radio wave emitted from the coil antenna tends to be too small to perform efficient wireless power feeding on the portable device.

It is an object of the present invention to provide a switch device which is capable of increasing the intensity of a radio wave emitted from a coil antenna though the size of the switch device itself is prevented from having an increased size.

A switch device according to the present invention includes a tubular case, a circuit board disposed in the case, a control button disposed for movement along longitudinal directions of the case, the control button being actuated by pressing from outside of the switch device, a switch unit mounted on the circuit board, the switch unit being actuated in response to rearward movement of the control button by pressing, and a coil antenna electrically connected to the circuit board, for emitting a radio wave for energizing an external portable device, wherein the coil antenna is disposed rearwardly of the control button and has an outside diameter which is substantially same as an outside diameter of the control button.

With the switch device according to the present invention, since the coil antenna is disposed rearwardly of the control button and has the outside diameter that is essentially the same as the outside diameter of the control button, the switch device is prevented from increasing in size, while at the same time the intensity of a radio wave emitted from the coil antenna is increased. As the outside diameter of the control button and the outside diameter of the coil antenna are essentially the same as each other, the switch device can easily be constructed in a constant-diameter cylindrical shape. Therefore, the layout of various components of the switch device can be designed with increased freedom.

In the switch device described above, the control button and the coil antenna may be disposed coaxially with each other.

Inasmuch as the control button and the coil antenna may be disposed coaxially with each other, it is possible to efficiently prevent the switch device from increasing in size.

The switch device described above may further include a slider disposed in the case for sliding movement along the longitudinal directions while allowing the switch unit to be actuated, the control button being disposed on a front end of the slider.

The switch unit can thus be actuated reliably upon rearward movement of the slider by pressing the control button.

In the switch device described above, the circuit board may have a mounting surface facing forwardly, and the switch unit may have a contact assembly disposed on the mounting surface, the contact assembly being elastically deformable.

As the contact assembly that is elastically deformable may be disposed on the mounting surface of the circuit board by pressing the control button, the slider is moved rearwardly to elastically deform the contact assembly thereby to actuate the switch unit. When the control button is released, the contact assembly springs back to its original shape. Under the elastic force of the contact assembly, the slider and the control button are moved forwardly with respect to the case. Since there is no need to have any urging means for urging the slider forwardly separately from the switch unit, the number of parts of the switch device is not unduly increased.

In the switch device described above, the case may have a movement limiter for limiting the slider against rearward movement upon contacting a rear end of the slider.

Since the case has the movement limiter for limiting the slider against rearward movement upon contacting the rear end of the slider, even if the pressing force applied to the control button is relatively large, excessive forces are prevented from being applied to the contact assembly, so that the circuit board is protected against undue damage.

The switch device described above may further include an antenna assembly having the coil antenna and a bobbin supporting the coil antenna and disposed on a front surface of the circuit board.

With the bobbin being disposed on the front surface of the circuit board, the distance between the coil antenna and the circuit board is relatively short, thereby simplifying the structure of the antenna assembly and making it easy to assemble the antenna assembly.

The switch device described above may further include a plurality of light-emitting elements mounted on the mounting surface of the circuit board, for illuminating the control button.

As the light-emitting elements are disposed on the mounting surface of the circuit board, the aesthetic appearance and visibility of the control buttons is increased. Since the circuit board has its mounting surface facing forwardly, the light-emitting elements can easily be placed in position.

In the switch device described above, the slider may have a plurality of light guides for guiding light emitted from the light-emitting elements to the control button.

Since the switch device may have the light guides for guiding light emitted from the respective light-emitting elements to the control button, the aesthetic appearance and visibility of the control buttons is further increased. As the light guides are disposed on the slider, the control button and the slider are prevented from interfering with the light guides when the control button and the slider are moved with respect to the case along the longitudinal directions.

The switch device described above may further include an antenna assembly having the coil antenna and a bobbin supporting the coil antenna and disposed on a reverse side of the circuit board.

Since the bobbin is disposed on the reverse side of the circuit board, the distance between the coil antenna and the circuit board is relatively short, thereby simplifying the structure of the antenna assembly and making it easy to assemble the antenna assembly.

The switch device described above may further include a slider disposed in the case for sliding movement along the longitudinal directions while allowing the switch unit to be actuated, the control button being disposed on a front end of the slider, wherein the circuit board may have a mounting surface facing forwardly, the switch unit being mounted on the mounting surface, and the coil antenna may be disposed rearwardly of the circuit board.

Inasmuch as the coil antenna is disposed behind the circuit board, the distance between the control button and the circuit board is shorter and the slider is smaller in size than if the coil antenna is disposed between the control button and the circuit board. Therefore, the switch device with the coil antenna disposed in a front region thereof can be made small in size along the longitudinal directions thereof.

According to the present invention, since the coil antenna is disposed rearwardly of the control button and has the outside diameter that is essentially the same as the outside diameter of the control button, the switch device is prevented from increasing in size, while at the same time the intensity of a radio wave emitted from the coil antenna is increased.

The above and other objects, features, and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Switch devices according to preferred embodiments of the present invention will be described in detail below with reference to the accompanying drawings.

First Embodiment

Figure 1:
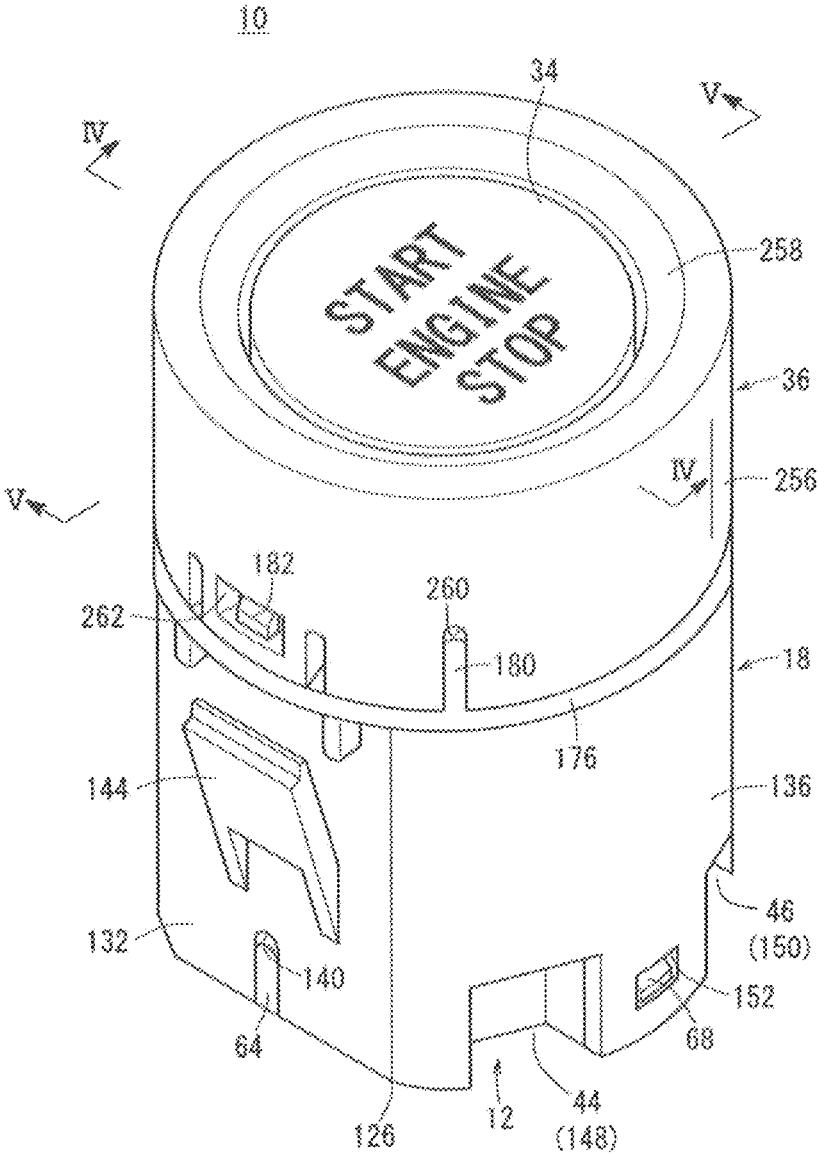
FIG. 1 is a perspective view of a switch device according to a first embodiment of the present invention.

FIG. 1 shows in perspective view a switch device 10 according to a first embodiment of the present invention. The switch device 10 is constructed as an engine starter switch to be mounted on the instrument panel of a vehicle. The switch device 10 makes the engine on the vehicle ready to start when the driver of the vehicle presses a control button 34 of the switch device 10 providing that a portable device carried by the driver and the vehicle have their ID information agreeing with each other upon communication with each other. In the description that follows, an upper side (closer to the control button 34) of the switch device 10 shown in FIG. 10 will be referred to as "front", "forward", or "forwardly", and a lower side (closer to a base 12) of the switch device 10 as "rear", "rearward", or "rearwardly".

As shown in FIGS. 1 through 5, the switch device 10 includes the base 12 as a rear end portion of the switch device 10, a circuit board 14 mounted on the base 12, a cover 16 covering a front face of the circuit board 14, a tubular holder case 18 extending in the longitudinal (front-back, or axial) directions of the switch device 10 and holding the base 12 in its rear end portion, an antenna assembly 20 disposed in the holder case 18, a slider 22 mounted in the holder case 18 for sliding movement along the longitudinal directions of the holder case 18, first through fourth light guides 24, 26, 28, 30 supported on the slider 22, a circular film 32 disposed on a front face of the slider 22, the control button 34 made of a transparent material and movable along the longitudinal directions of the holder case 18, the control button 34 being actuated by pressing from outside of the switch device 10, and an outer case 36 mounted on a front end portion of the holder case 18 and housing a front end portion of the slider 22 and the control button 34.

The base 12 has a tubular connector mount 38 extending along the longitudinal directions and serving as a basis on which a connector, not shown, is to be mounted, and a terminal support 42 supporting a plurality of terminals 40 that are electrically connected to the circuit board 14.

Figure 6:
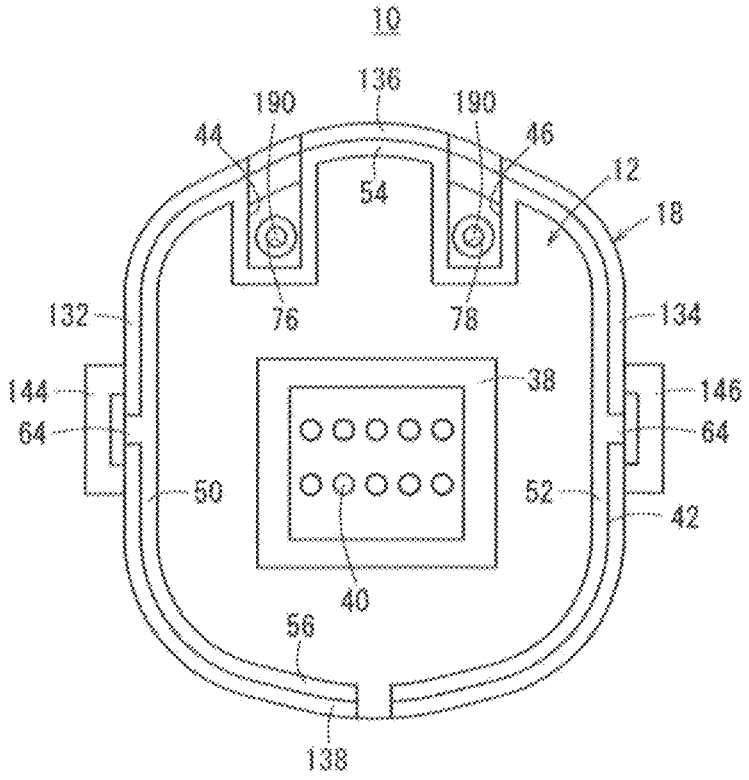
FIG. 6 is a bottom view of the switch device shown in FIG. 1.

The connector mount 38 has a shape complementary to the shape of the connector, e.g., a tubular shape having a rectangular cross section (see FIG. 6). The terminals 40 are in the form of a plurality of thin metal bars.

Figure 3:
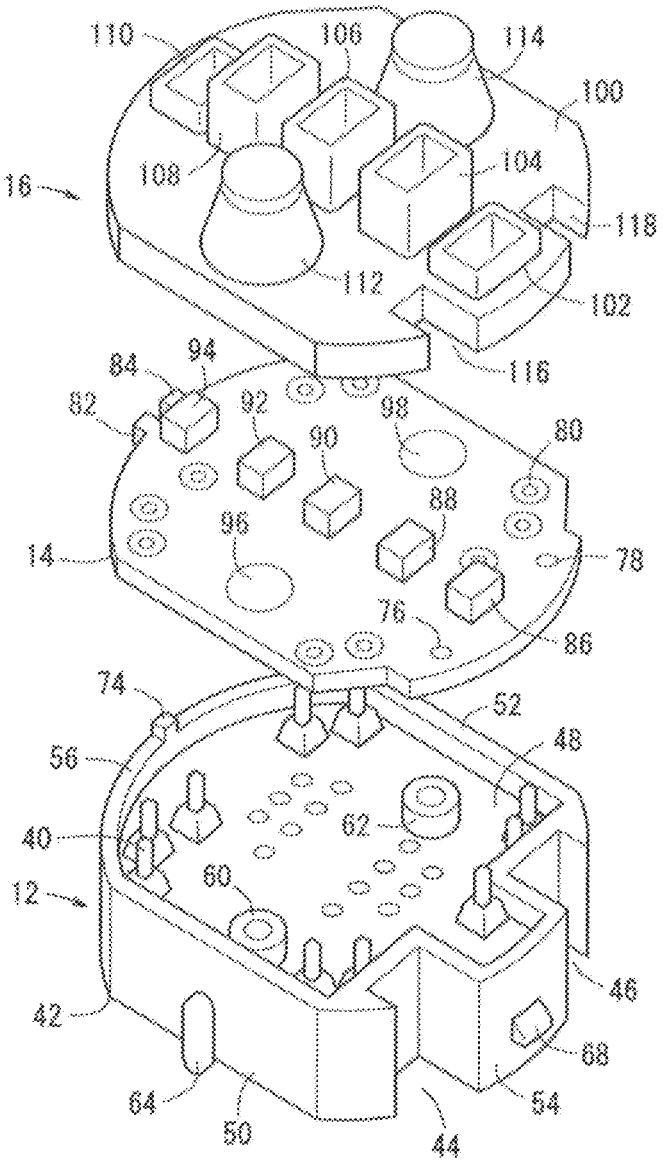
FIG. 3 is an enlarged perspective view of a base, a circuit board, and a cover shown in FIG. 2.

As shown in FIG. 3, the terminal support 42 is of a rectangular shape as viewed in plan and has two opposite shorter sides projecting arcuately outwardly. One of the arcuate sides has a pair of recesses 44, 46 defined therein which are symmetrically shaped and spaced along widthwise or transverse directions perpendicular to longer sides of the rectangular shape.

The terminal support 42 includes a flat plate 48 integrally joined to a front end of the connector mount 38 and having a planar shape similar to the planar shape of the terminal support 42, a pair of side walls 50, 52, extending from respective sides of the flat plate 48 along the longitudinal directions, a central arcuate wall 54, which corresponds to a central portion of the arcuate side with the recesses 44, 46, extending from a transversely central portion of an end of the flat plate 48 along the longitudinal directions, and an arcuate wall 56, which corresponds to the other arcuate side, extending from an opposite end of the flat plate 48 along the longitudinal directions.

Figure 7:
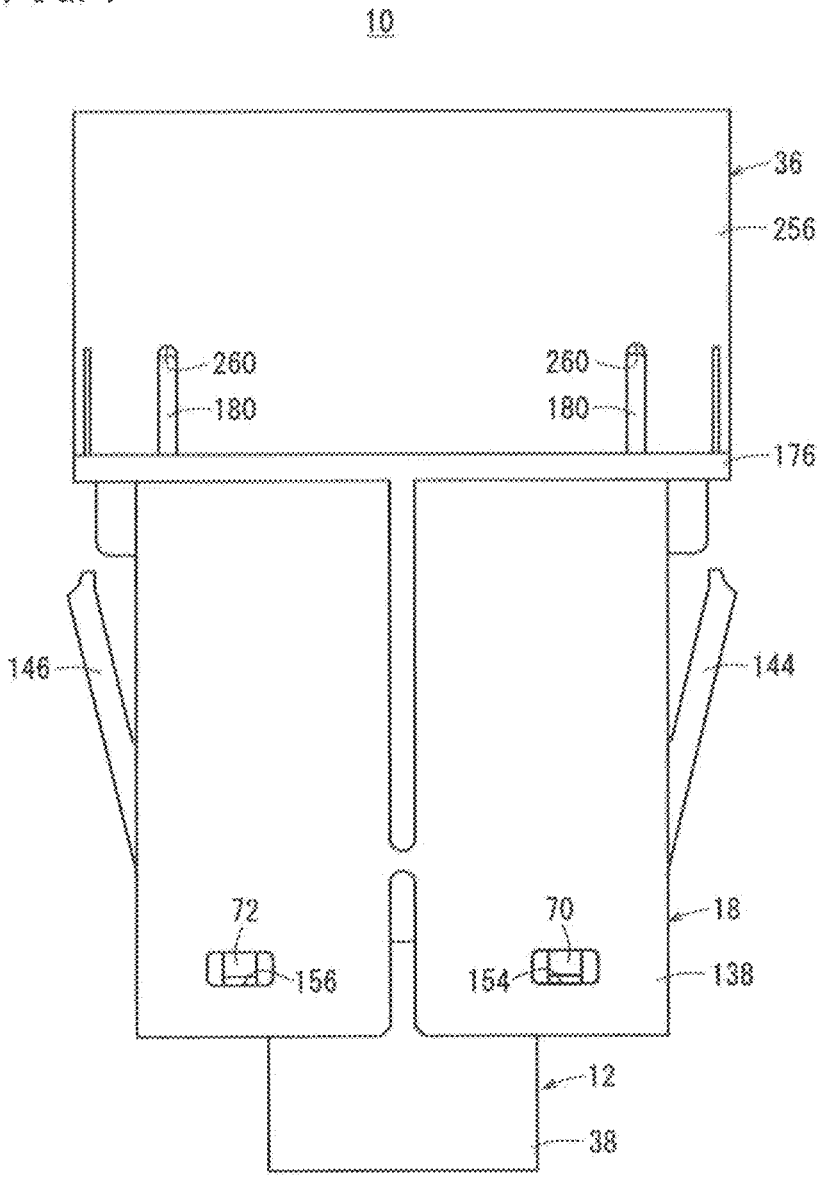
FIG. 7 is a side view of the switch device shown in FIG. 1.

A pair of bushings 60, 62 which support the circuit board 14 thereon are mounted on a front face of the flat plate 48 and spaced apart from each other along the widthwise directions thereof. Positioning ridges 64 for positioning the base 12 in a given position in the holder case 18 are disposed on respective outer side surfaces of the side walls 50, 52. A mounting tooth 68 for mounting the base 12 in the holder case 18 is disposed on an outer side wall of the central arcuate wall 54. A pair of mounting teeth 70, 72 (see FIG. 7), each identical in shape to the mounting tooth 68, are disposed on an outer side wall of the arcuate wall 56. A tongue 74 that projects forwardly is disposed on a front face of the arcuate wall 56.

The circuit board 14 is disposed in the holder case 18 such that it has a mounting surface (component side) faces forwardly. Specifically, the circuit board 14 is of a rectangular shape as viewed in plan and has two opposite shorter sides projecting arcuately outwardly and longer sides. One of the arcuate sides has a pair of cut-off corners joined to the longer sides, respectively. When the circuit board 14 is mounted on the base 12, a gap S (see FIG. 4) is created between the circuit board 14 and the flat plate 48.

The circuit board 14 has a pair of first insertion holes 76, 78 defined in an end thereof. The first insertion holes 76, 78 serve to receive respective antenna terminals 190 (see FIG. 2) of the antenna assembly 20. The first insertion hole 76 is open into the recess 44 in the base 12, and the first insertion hole 78 is open into the recess 46 in the base 12.

The antenna terminals 190 can thus be inserted from the front side of the circuit board 14 through the first insertion holes 76, 78 and soldered to the circuit board 14 from the rear side of the circuit board 14 (see FIG. 6). Consequently, since the antenna terminals 190 of the antenna assembly 20 can be electrically connected to the circuit board 14 after the antenna assembly 20 has been placed in the holder case 18, the switch device 10 can easily be assembled.

The circuit board 14 has a plurality of second insertion holes 80 defined therein for receiving the terminals 40 inserted therein. According to the first embodiment, the terminals 40 are inserted through the second insertion holes 80 from the rear side of the circuit board 14 and then soldered to the circuit board 14 on the front side thereof, so that the terminals 40 are electrically connected to the circuit board 14.

The circuit board 14 has a pair of teeth 82, 84 projecting outwardly from the other arcuate side thereof. When the circuit board 14 is mounted on the base 12, the tongue 74 of the terminal support 42 is inserted between the teeth 82, 84, thereby positioning the circuit board 14 with respect to the base 12.

The circuit board 14 has on its front surface (mounting surface or component side) a plurality of (five in the first embodiment) light-emitting elements 86, 88, 90, 92, 94 for emitting light forwardly and a pair of fixed contacts 96, 98. The light-emitting elements 86, 88, 90, 92, 94 are arrayed in line along the longitudinal directions of the circuit board 14 which extend across the arcuate sides of the circuit board 14. Each of the light-emitting elements 86, 88, 90, 92, 94 may comprise, but is not limited to, an LED. The light-emitting elements 86, 88, 90, 92, 94 emit light having wavelengths (colors) different from each other. However, all or some of the light-emitting elements 86, 88, 90, 92, 94 may emit light having one wavelength (color).

The fixed contacts 96, 98 are arrayed in line along widthwise or transverse directions perpendicular to the longer sides of the circuit board 14. The fixed contact 96 is positioned in front of the bushing 60, and the fixed contact 98 is positioned in front of the bushing 62. Thus, when the fixed contacts 96, 98 are pressed, the circuit board 14 is prevented from flexing excessively and allowing switch contacts to be opened and closed well for reliable switch operation.

The cover 16 comprises an integrally molded member of a resin material such as rubber or the like. The cover 16 has a plate-like cover body 100 disposed over the front side of the circuit board 14, a plurality of (five in the first embodiment) housing tubes 102, 104, 106, 108, 110 mounted on the cover body 100 and housing the respective light-emitting elements 86, 88, 90, 92, 94 therein, and a pair of contact assemblies (rubber contact assemblies) 112, 114 disposed in alignment with the respective fixed contacts 96, 98.

The cover body 100 is of a rectangular shape as viewed in plan and has two opposite shorter sides projecting arcuately outwardly. One of the arcuate sides has a pair of recesses 116, 118 defined therein. The recesses 116, 118 serve to receive the respective antenna terminals 190 inserted therein.

Each of the housing tubes 102, 104, 106, 108, 110 has a tubular shape having a rectangular cross section. The housing tubes 102, 110 which are positioned at the opposite ends of the array of the housing tubes 102, 104, 106, 108, 110 have a height smaller than the other housing tubes 104, 106, 108 that are positioned between the housing tubes 102, 110.

According to the first embodiment, since the cover 16 has the housing tubes 102, 104, 106, 108, 110 which house the respective light-emitting elements 86, 88, 90, 92, 94 therein, light emitted from the light-emitting elements 86, 88, 90, 92, 94 is prevented from leaking out of the switch device 10 and from interfering with each other.

Figure 5:
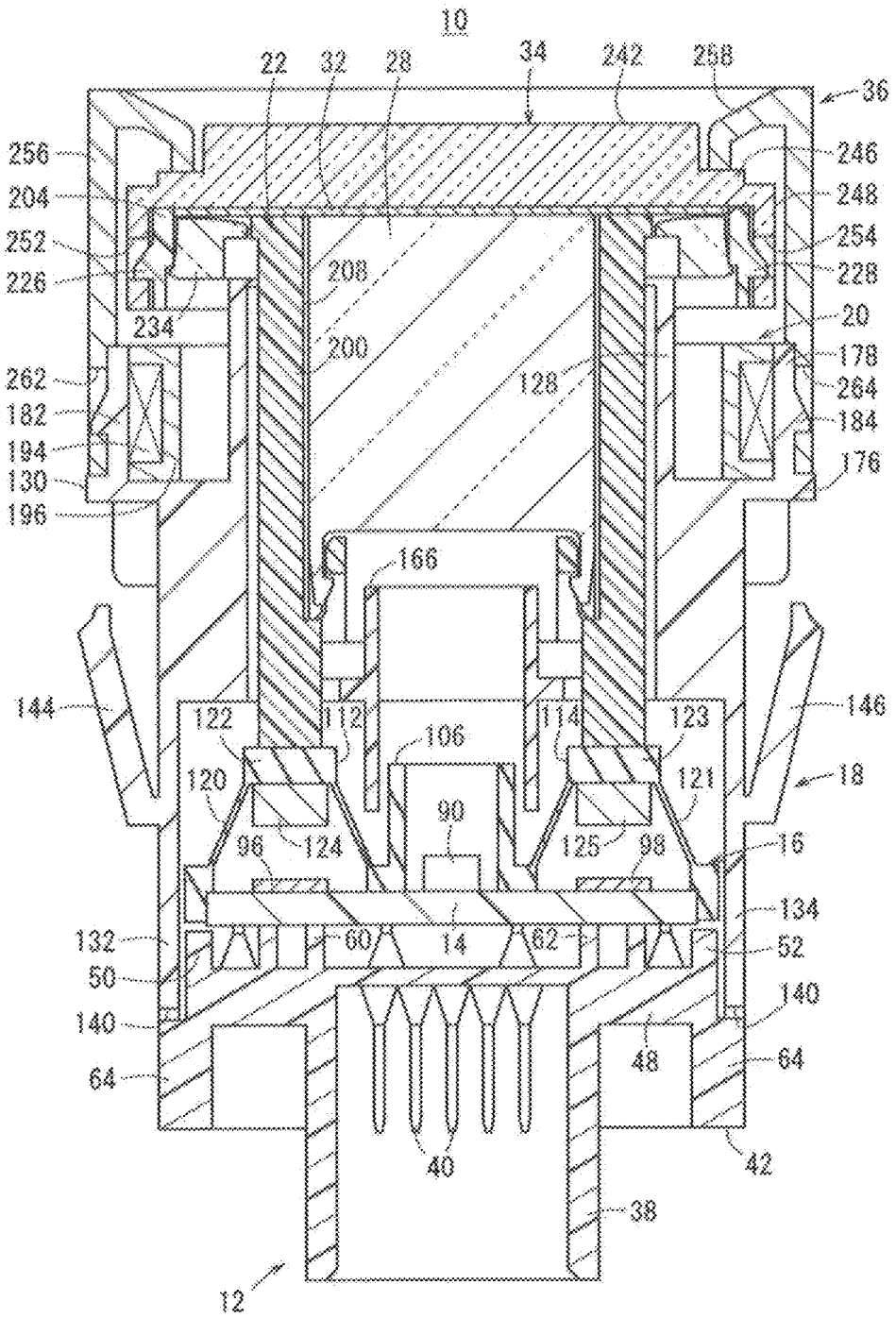
FIG. 5 is an enlarged cross-sectional view taken along line V-V of FIG. 1.

As shown in FIG. 5, the contact assembly 112 is of a frustoconical shape having a thin side wall 120 and a thick contact wall 122 disposed on a front end of the side wall 120. A movable contact 124 is fixed to an inner, i.e. lower, surface of the contact wall 122 for contact with the fixed contact 96.

The contact assembly 114, which is identical in structure to the contact assembly 112, has a side wall 121 and a contact wall 123. A movable contact 125 is fixed to an inner, i.e. lower, surface of the contact wall 123 for contact with the fixed contact 98. According to the first embodiment, the fixed contacts 96, 98, the contact assemblies 112, 114, and the movable contacts 124, 125 function as a switch unit.

Figure 2:
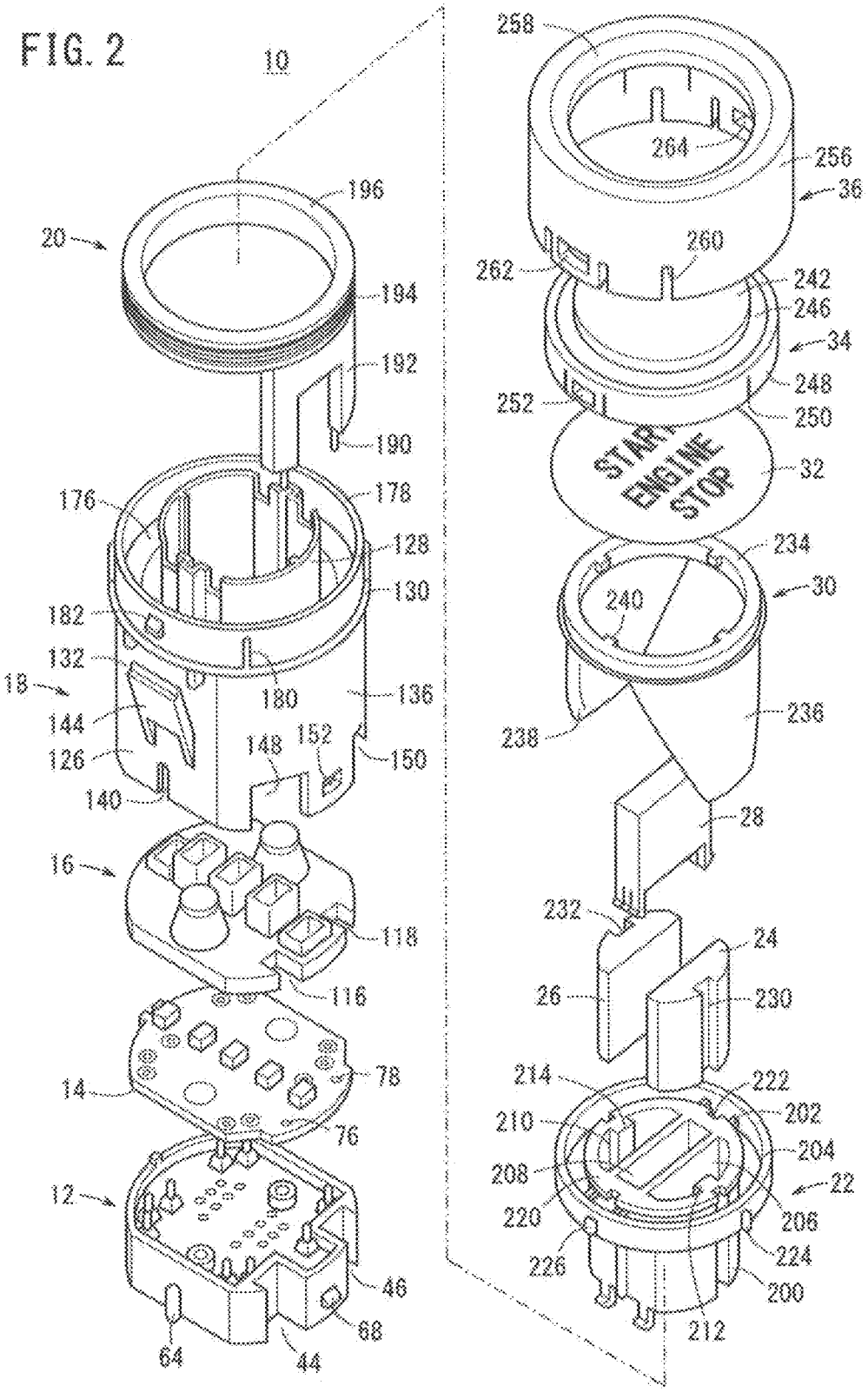
FIG. 2 is an exploded perspective view of the switch device shown in FIG. 1.
Figure 4:
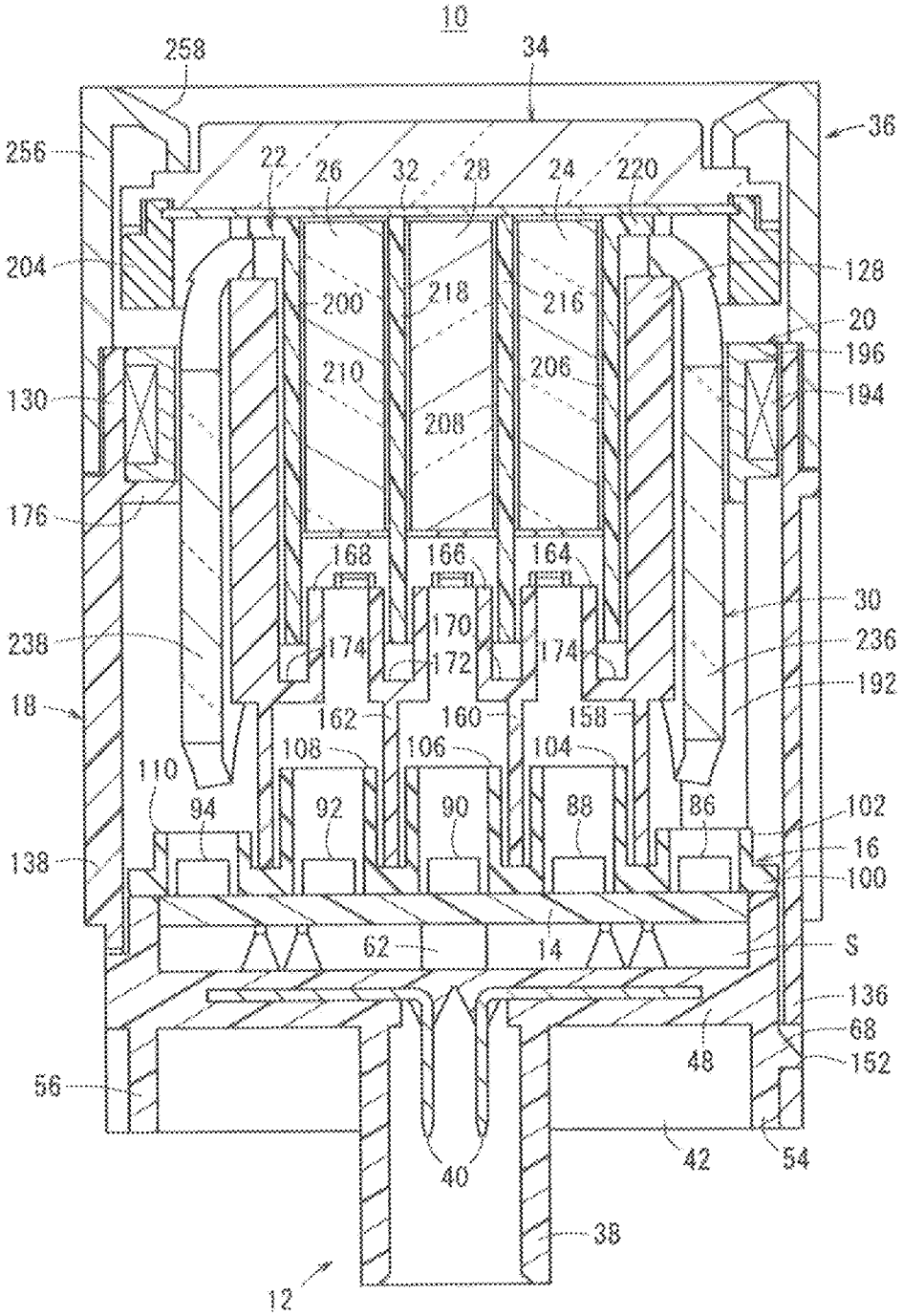
FIG. 4 is an enlarged cross-sectional view taken along line IV-IV of FIG. 1.

As shown in FIGS. 2, 4, and 5, the holder case 18, which comprises an integrally molded member of a resin material, has a tubular case body 126 housing and holding the terminal support 42 therein, a tubular slider support 128 disposed in the case body 126 and supporting the slider 22 slidably thereon, and an outer case holder 130 disposed on the front end of the case body 126 and holding the outer case 36 thereon.

The case body 126 is of a shape similar to the terminal support 42 and has a pair of flat walls 132, 134 facing each other and a pair of arcuate walls 136, 138 interconnecting the flat walls 132, 134. The walls 132, 134 have respective slots 140 defined in rear end portions thereof for receiving the respective positioning ridges 64 of the base 12. The walls 132, 134 also have a pair of teeth 144, 146 disposed on outer surfaces thereof and positioned centrally in the longitudinal directions. The teeth 144, 146 serve to mount the holder case 18 (the switch device 10) on the instrument panel, not shown.

The arcuate wall 136 has a pair of holes 148, 150 defined in a rear end portion thereof in alignment with the respective recesses 44, 46 in the base 12. The arcuate wall 136 also has a mounting hole 152 defined therein between the holes 148, 150 for receiving the mounting tooth 68 of the base 12 fitted therein. The other arcuate wall 138 has a pair of mounting holes 154, 156 (see FIG. 7) defined in a rear end portion thereof for receiving the respective mounting teeth 70, 72 of the base 12 fitted therein.

When the positioning ridges 64 of the base 12 are inserted into the respective slots 140 in the case body 126 and the base 12 is pushed forwardly, the mounting teeth 68, 70, 72 of the base 12 snap into the respective mounting holes 152, 154, 156 in the case body 126, and are fitted therein. The base 12 is thus reliably fixed to the rear end portion of the holder case 18.

According to the first embodiment, the mounting teeth 68, 70, 72 may be replaced with mounting holes defined in the base 12, and the mounting holes 152, 154, 156 may be replaced with mounting teeth on the base body 126.

As shown in FIG. 4, the slider support 128 has a first tube 158 projecting rearwardly from a rear end thereof and housing the housing tubes 104, 106, 108 therein, a pair of partition walls 160, 162 disposed between adjacent ones of the housing tubes 104, 106, 108, three second tubes 164, 166, 168 arranged in an array along the array of the light-emitting elements 86, 88, 90, 92, 94, a pair of first joints 170, 172 joining adjacent ones of the second tubes 164, 166, 168, and a pair of second joints 174 joining the second tubes 164, 166, 168 to the slider support 128.

The first tube 158, which projects rearwardly from the rear end of the slider support 128, is held in abutment against a front surface of the cover body 100. The partition wall 160 projects rearwardly from the first joint 170 and is held in abutment against the front surface of the cover body 100. The partition wall 162 projects rearwardly from the first joint 172 and is held in abutment against the front surface of the cover body 100.

The second tube 164 is positioned in front of the housing tube 104, the second tube 166 in front of the housing tube 106, and the second tube 168 in front of the housing tube 108. When the control button 34 is not operated, i.e., not pressed, the first joints 170, 172 and the second joints 174 are spaced from the slider 22.

The outer case holder 130 has a ring (rest) 176 disposed on a front end of the case body 126 and a hollow cylinder 178 extending forwardly from the ring 176. The hollow cylinder 178 has an outside diameter slightly smaller than the outside diameter of the ring 176. The hollow cylinder 178 has on an outer circumferential surface thereof a positioning tooth 180 for positioning the outer case 36 in a given position on the holder case 18 and a pair of mounting teeth 182, 184 (see FIG. 5) for mounting the outer case 36 on the holder case 18.

The antenna assembly 20 has the antenna terminals 190 that are electrically connected to the circuit board 14, a support 192 supporting the antenna terminals 190, a coil antenna 194 comprising a wire coil for wireless power feeding, and an annular bobbin 196 supporting the coil antenna 194.

The antenna terminals 190 are insert-molded in the support 192 and electrically connected to the coil antenna 194. The coil antenna 194 emits a radio wave for energizing the portable device. The bobbin 196 is disposed within the hollow cylinder 178 of the holder case 18 and held in contact with a front surface of the ring 176.

The slider 22 is supported on the slider support 128 such that the slider 22 has its front end projecting forwardly beyond the holder case 18. The slider 22 has a slider body 200 extending along the longitudinal directions and an annular holder 204 connected to a front end of the slider body 200 by connectors 202. The slider body 200 has a rear end held in contact with the contacts assemblies 112, 114.

The slider body 200 has three holes 206, 208, 210 defined therein which extend along the longitudinal directions. The holes 206, 208, 210 are arranged in an array along the array of the light-emitting elements 86, 88, 90, 92, 94. The hole 206 is defined by a wall having an engaging ridge 212 extending along the longitudinal directions, and the hole 210 is defined by a wall having an engaging ridge 214 extending along the longitudinal directions.

Figure 8:
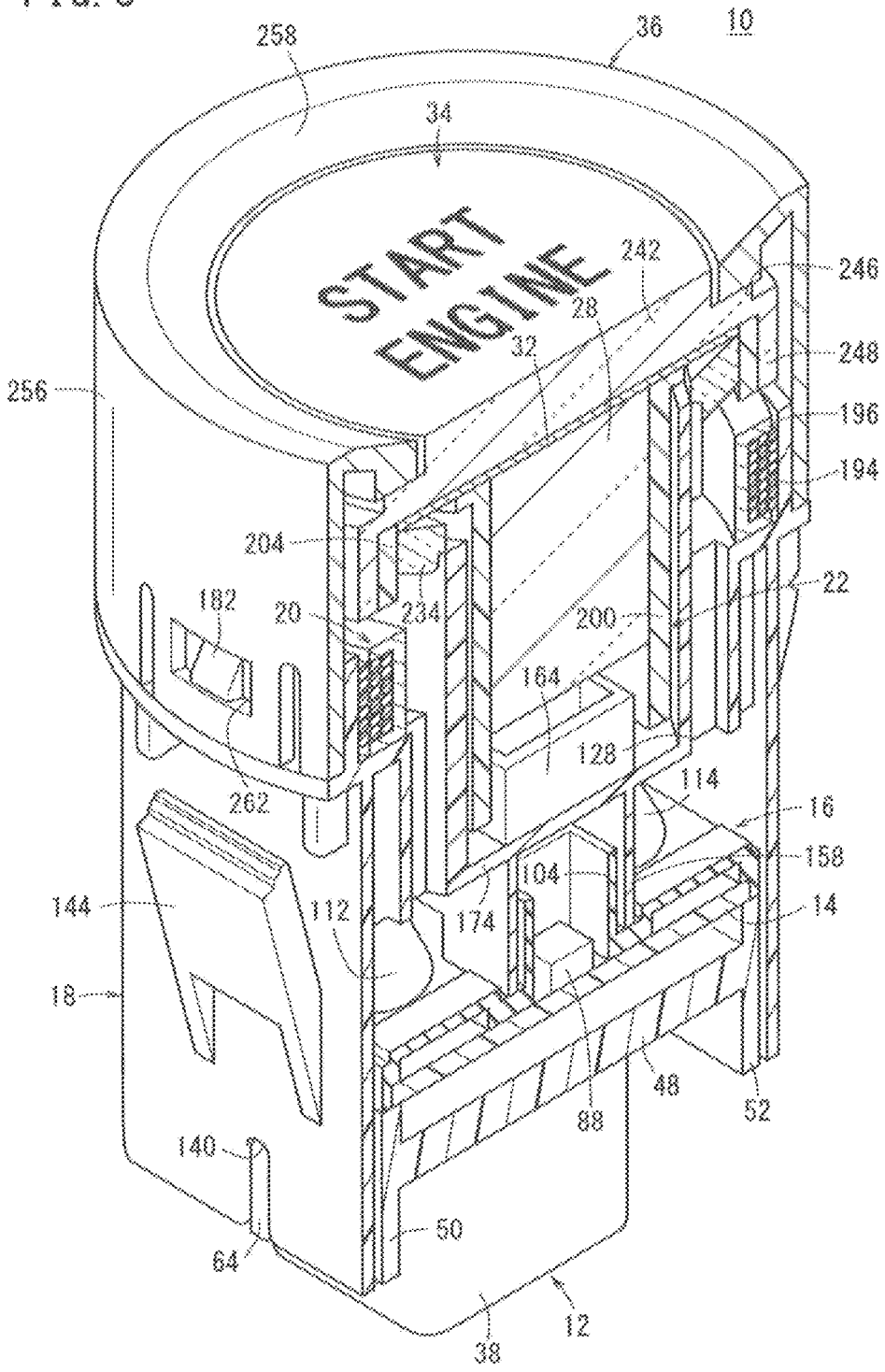
FIG. 8 is a perspective view, partly in cross section, of the switch device shown in FIG. 1.

As shown in FIGS. 4 and 8, the holes 206, 208 are divided by a partition wall 216 that is positioned forwardly of and spaced from the first joint 170, and the holes 208, 210 are divided by a partition wall 218 that is positioned forwardly of and spaced from the first joint 172. The slider body 200 is positioned forwardly of and spaced from the second joints 174. The slider body 200 has an annular flange 220 disposed on a front end thereof and having recesses 222 (see FIG. 2) defined therein for positioning the fourth light guide 30 in a given position in the slider 22.

A predetermined gap is present between the slider body 200 and the holder 204. The holder 204 is positioned forwardly of and spaced from the bobbin 196 (see FIG. 4). The holder 204 has on an outer circumferential surface thereof a positioning tooth 224 for positioning the control button 34 on the slider 22 and a pair of mounting teeth 226, 228 (see FIG. 5) for mounting the control button 34 on the slider 22.

The first light guide 24 is in the form of a block extending along the longitudinal directions and has an engaging groove 230 defined therein which extends the entire length of the first light guide 24. The first light guide 24 is disposed in the hole 206 with the engaging ridge 212 inserted in the engaging groove 230. The first light guide 24 that is disposed in the hole 206 guides light emitted from the light-emitting element 88 to the control button 34.

The second light guide 26, which is identical in structure to the first light guide 24, has an engaging groove 232. The second light guide 26 is disposed in the hole 210 with the engaging ridge 214 inserted in the engaging groove 232. The second light guide 26 that is disposed in the hole 210 guides light emitted from the light-emitting element 92 to the control button 34.

The third light guide 28 is substantially in the form of a parallelepiped. The third light guide 28 that is disposed in the hole 208 guides light emitted from the light-emitting element 90 to the control button 34.

The fourth light guide 30 includes an annular light guide member 234, a light guide member 236 for guiding light emitted from the light-emitting element 86 to the annular light guide member 234, and a light guide member 238 for guiding light emitted from the light-emitting element 94 to the annular light guide member 234.

The annular light guide member 234 has engaging teeth 240 disposed on an inner circumferential surface thereof and projecting radially inwardly. The fourth light guide 30 is disposed in the gap between the slider body 200 and the holder 204 with the engaging teeth 240 inserted in the recesses 222 defined in the flange 220.

The circular film 32 disposed on the front face of the slider 22 is marked with letters "START", "ENGINE", "STOP". The control button 34 has a presser 242 in the form of a circular plate, an extension 246 projecting radially outwardly from a rear end of the presser 242, and an annular wall 248 extending rearwardly from a circumferential edge of the extension 246. The annular wall 248 has a slot 250 defined therein for receiving the positioning tooth 224 of the slider 22 inserted therein, and a pair of mounting holes 252, 254 (see FIG. 5) for receiving the mounting teeth 226, 228 fitted respectively therein.

When the positioning tooth 224 of the slider 22 is inserted into the slot 250 in the control button 34 and then the control button 34 is pushed rearwardly, the mounting teeth 226, 228 of the slider 22 snap into the respective mounting holes 252, 254 in the control button 34, and are fitted therein. The control button 34 is thus reliably fixed to the front end portion of the slider 22.

According to the first embodiment, the mounting teeth 226, 228 may be replaced with mounting holes defined in the slider 22, and the mounting holes 252, 254 may be replaced with mounting teeth on the control button 34.

As shown in FIGS. 4 and 5, the outside diameter of the control button 34, i.e., the outside diameter of the annular wall 248, is essentially the same as the outside diameter of the coil antenna 194. With this arrangement, the switch device 10 is prevented from increasing in size, and the intensity of a radio wave emitted from the coil antenna 194 is increased. The control button 34 and the coil antenna 194 that is positioned rearwardly of the control button 34 are disposed coaxially with each other, making it possible to efficiently prevent the switch device 10 from increasing in size.

The outer case 36 has a hollow cylindrical circumferential wall 256 and an annular stopper flange 258 disposed on a front end of the circumferential wall 256. The circumferential wall 256 has a rear end portion having a slot 260 defined therein for receiving the positioning tooth 180 of the holder case 18 inserted therein, and a pair of mounting holes 262, 264 (see FIG. 5) for receiving the mounting teeth 182, 184 of the holder case 18 fitted respectively therein.

When the positioning tooth 180 of the holder case 18 is inserted into the slot 260 in the outer case 36 and then the outer case 36 is pushed rearwardly, the mounting teeth 182, 184 of the holder case 18 snap into the respective mounting holes 262, 264 in the outer case 36, and are fitted therein easily. The outer case 36 is thus reliably fixed to the holder case 18. At this time, the stopper flange 258 is held in contact with the extension 246 of the control button 34.

According to the first embodiment, the mounting teeth 182, 184 may be replaced with mounting holes defined in the holder case 18, and the mounting holes 262, 264 may be replaced with mounting teeth on the outer case 36.

The switch device 10 according to the first embodiment is basically constructed as described above. Operation of the switch device 10 will be described below.

When the portable device carried by the driver of the vehicle and the vehicle communicate with each other and their ID information agrees with each other, the driver presses the control button 34 of the switch device 10. The slider 22 moves rearwardly with respect to the holder case 18, causing the slider body 200 to press the contact assemblies 112, 114.

The side wall 120 of the contact assembly 112 is elastically deformed and the contact wall 122 is displaced rearwardly, bringing the movable contact 124 into contact with the fixed contact 96. The side wall 121 of the contact assembly 114 is elastically deformed and the contact wall 123 is displaced rearwardly, bringing the movable contact 125 into contact with the fixed contact 98. The circuit board 14 of the switch device 10 now supplies a signal to a controller (ECU) of the vehicle, making the engine ready to start.

At this time, the partition wall 216 of the slider body 200 is held in contact with the first joint 170 of the holder case 18, the partition wall 218 of the slider body 200 is held in contact with the first joint 172 of the holder case 18, and the outer wall of the slider body 200 is held in contact with the second joint 174 of the holder case 18. Consequently, even if the pressing force applied by the control button 34 is relatively large, excessive forces are prevented from being applied to the contact assemblies 112, 114, so that the circuit board 14 is protected against undue damage.

When the engine is ready to start, all or some of the light-emitting elements 86, 88, 90, 92, 94 emit light. According to the first embodiment, however, the light-emitting elements 86, 88, 90, 92, 94 may be energized to emit light when the engine is not ready to start.

The light emitted from the light-emitting element 88 passes through the first light guide 24 and illuminates the letters "STOP" on the film 32. The light emitted from the light-emitting element 90 passes through the third light guide 28 and illuminates the letters "ENGINE" on the film 32. The light emitted from the light-emitting element 92 passes through the second light guide 26 and illuminates the letters "START" on the film 32. The light emitted from the light-emitting element 86 passes through the light guide member 236 and is guided thereby to the annular light guide member 234, and the light emitted from the light-emitting element 94 passes through the light guide member 238 and is guided thereby to the annular light guide member 234. The light guided to the annular light guide member 234 illuminates the control button 34 in a ring pattern, which is effective to increase the aesthetic appearance and visibility of the control button 34.

When the driver subsequently releases the control button 34, the side wall 120 of the contact assembly 112 and the side wall 121 of the contact assembly 114 spring back to their original shape, moving the movable contact 124 away from the fixed contact 96 and bringing the movable contact 125 away from the fixed contact 98. Under the elastic forces of the contact assemblies 112, 114, the slider 22 is moved forwardly with respect to the holder case 18, displacing the extension 246 of the control button 34 into contact with the stopper flange 258 of the outer case 36.

If the portable device fails to check the ID information against the vehicle due to a cell power failure, then the driver may hold the portable device in front of the control button 34 in the vicinity thereof, so that a radio wave emitted from the coil antenna 194 can induce an electromotive force in a transponder of the portable device for thereby performing wireless power feeding on the portable device.

With the switch device 10 according to the first embodiment, as described above, since the coil antenna 194 whose outside diameter is essentially the same as the outside diameter of the control button 34 is disposed rearwardly of the control button 34, the switch device 10 is prevented from increasing in size, while at the same time the intensity of a radio wave emitted from the coil antenna 194 is increased. As the outside diameter of the control button 34 and the outside diameter of the coil antenna 194 are essentially the same as each other, the switch device 10 can easily be constructed in a constant-diameter cylindrical shape. Therefore, the layout of various components of the switch device 10 can be designed with increased freedom. Furthermore, inasmuch as the control button 34 and the coil antenna 194 are disposed coaxially with each other, it is possible to efficiently prevent the switch device 10 from increasing in size.

According to the first embodiment, the control button 34 is disposed on the front end of the slider 22, and the slider 22 is disposed for longitudinal sliding movement in the slider support 128 while allowing the contact assemblies 112, 114 (switch unit) to be actuated. When the driver presses the control button 34, the slider 22 is moved rearwardly for reliably operating the contact assemblies 112, 114.

As the contact assemblies 112, 114 that are elastically deformable are disposed on the front surface (mounting surface) of the circuit board 14, when the driver presses the control button 34, the slider 22 is moved rearwardly to bring the movable contacts 124, 125 into contact with the fixed contacts 96, 98 by the elastic deformation of the contact assemblies 112, 114. When the driver releases the control button 34, the contact assemblies 112, 114 spring back to their original shape. Under the elastic forces of the contact assemblies 112, 114, the slider 22 and the control button 34 are moved forwardly with respect to the holder case 18. Since there is no need to have any urging means for urging the slider 22 forwardly separately from the contact assemblies 112, 114, the number of parts of the switch device 10 is not unduly increased.

According to the first embodiment, when the driver presses the control button 34, the slider 22 is moved rearwardly, bringing the partition wall 216 of the slider body 200 into contact with the first joint 170, the partition wall 218 of the slider body 200 into contact with the first joint 172, and the outer wall of the slider body 200 into contact with the second joints 174. In other words, the first joints 170, 172 and the second joints 174 function as a movement limiter for limiting the slider 22 against rearward movement. Consequently, even if the pressing force applied by the control button 34 is relatively large, excessive forces are prevented from being applied to the contact assemblies 112, 114, so that the circuit board 14 is protected against undue damage.

According to the first embodiment, as the light-emitting elements 86, 88, 90, 92, 94 are disposed on the front surface of the circuit board 14, the aesthetic appearance and visibility of the control buttons 34 is increased. Since the circuit board 14 has its mounting surface facing forwardly, the light-emitting elements 86, 88, 90, 92, 94 can easily be placed in position.

Since the switch device 10 has the first through fourth light guides 24, 26, 28, 30 for guiding light emitted from the respective light-emitting elements 86, 88, 90, 92, 94 to the control button 34, the aesthetic appearance and visibility of the control buttons 34 is further increased. As the first through fourth light guides 24, 26, 28, 30 are disposed on the slider 22, the control button 34 and the slider 22 are prevented from interfering with the first through fourth light guides 24, 26, 28, 30 when the control button 34 and the slider 22 are moved with respect to the holder case 18 along the longitudinal directions.

Figure 9:
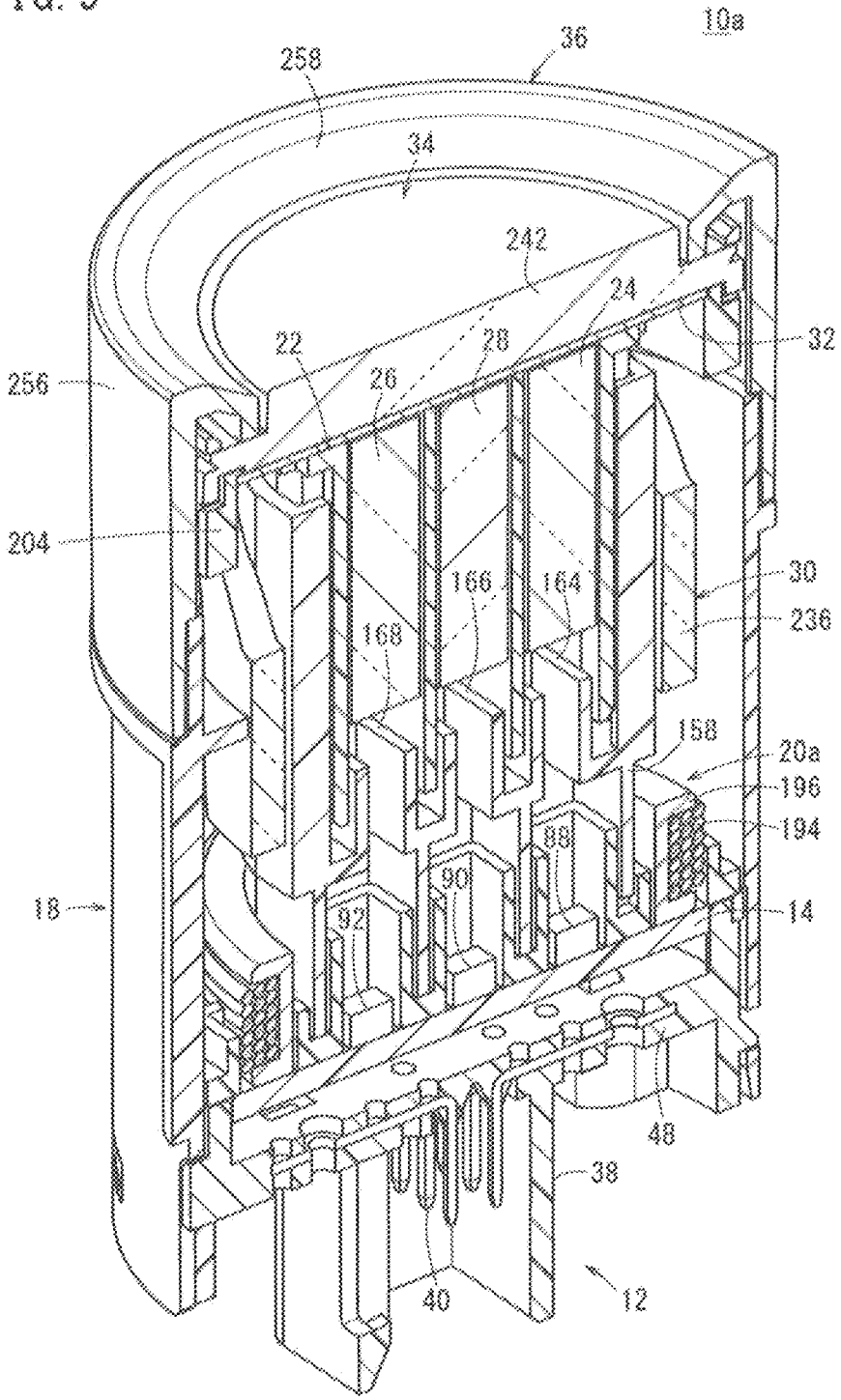
FIG. 9 is a perspective view, partly in cross section, of a switch device according to a modification of the first embodiment.

A switch device 10*a* according to a modification of the first embodiment will be described below. As shown in FIG. 9, the switch device 10*a* has an antenna assembly 20*a* which is different as to structure and layout from the antenna assembly 20 of the switch device 10. Specifically, the antenna assembly 20*a* has a coil antenna 194 comprising a wire coil for wireless power feeding and an annular bobbin 196 supporting the coil antenna 194.

In the antenna assembly 20*a*, the bobbin 196 is disposed on the front surface of the circuit board 14, and the coil antenna 194 and the circuit board 14 are electrically connected to each other by the antenna terminals 190 (not shown in FIG. 9). Specifically, the distance between the coil antenna 194 and the circuit board 14 of the switch device 10*a* is shorter than the distance between the coil antenna 194 and the circuit board 14 of the switch device 10. The antenna assembly 20*a* according to the modification is free of the support 192 supporting the antenna terminals 190.

According to the present modification, since the bobbin 196 is disposed on the front surface of the circuit board 14, the distance between the coil antenna 194 and the circuit board 14 is relatively short, thereby simplifying the structure of the antenna assembly 20*a* (by dispensing with the support 192) and making it easy to assemble the antenna assembly 20*a*.

Second Embodiment

A switch device 300 according to a second embodiment of the present invention will be described below with reference to FIGS. 10 through 12. Those components of the second embodiment which are identical to those of the first embodiment described above are denoted by identical reference characters, and will not be described in detail below.

Figure 10:
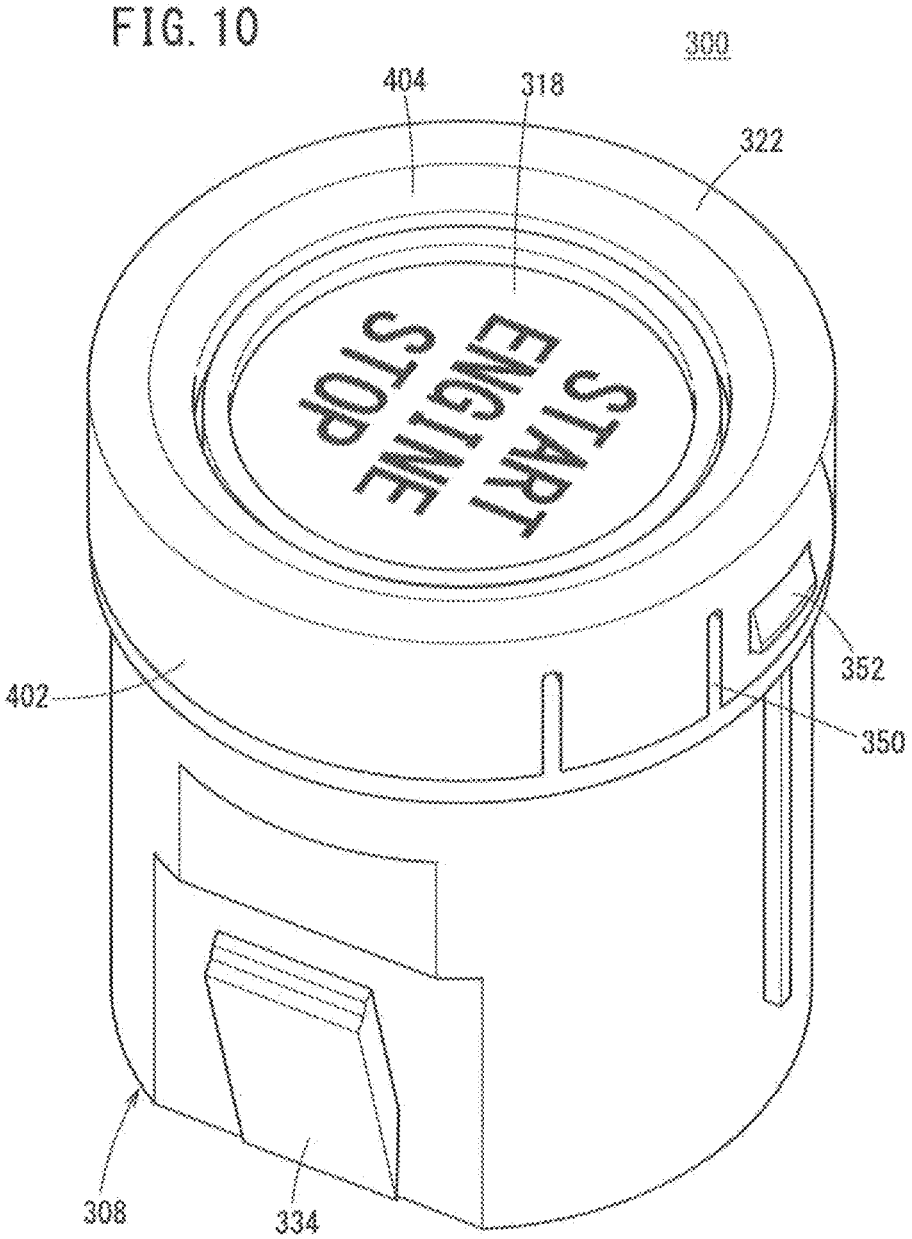
FIG. 10 is a perspective view of a switch device according to a second embodiment of the present invention.
Figure 11:
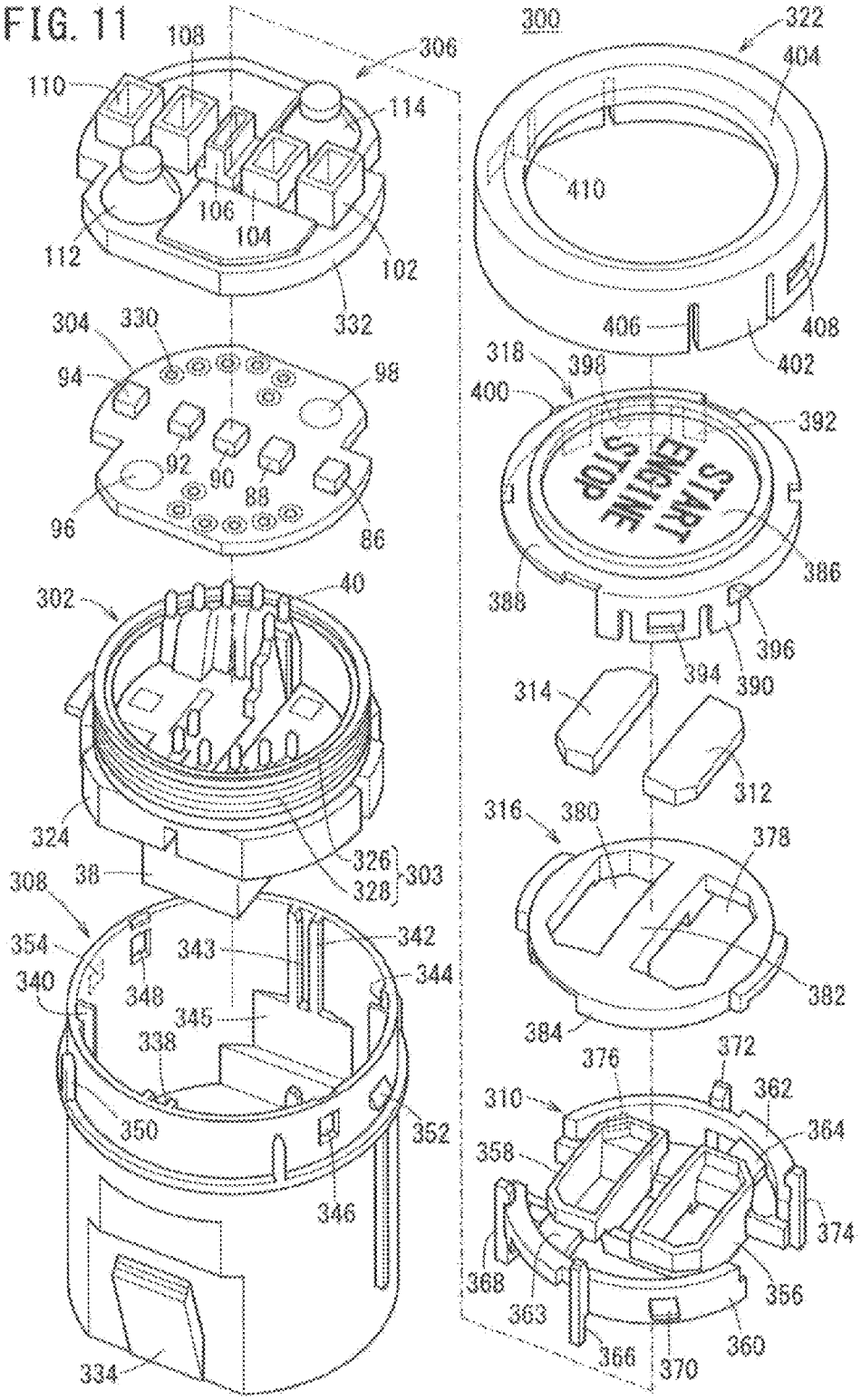
FIG. 11 is an exploded perspective view of the switch device shown in FIG. 10.
Figure 12:
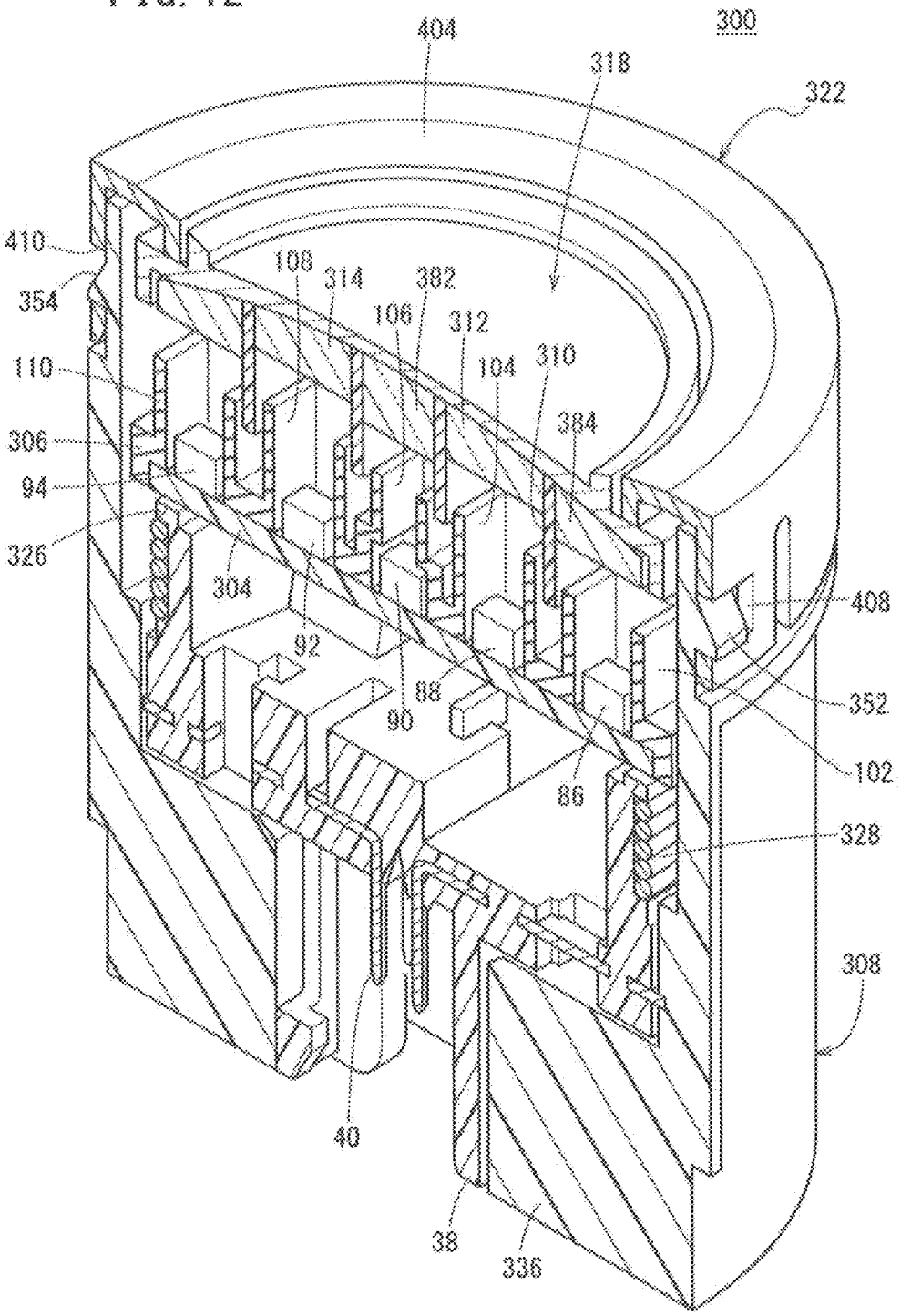
FIG. 12 is a perspective view, partly in cross section, of the switch device shown in FIG. 10.

As shown in FIGS. 10 through 12, the switch device 300, which is constructed as an engine starter switch, includes a base 302, an antenna assembly 303, a circuit board 304, a cover 306, a holder case 308, a slider 310, first through third light guides 312, 314, 316, a control button 318, and an outer case 322.

The base 302 serves as a rear end portion of the switch device 300, and has a terminal support 324 integral with the front end of the tubular connector mount 38 and supporting the terminals 40. The terminals 40 supported by the terminal support 324 are insert-molded therein and electrically connected to the circuit board 304. The terminal support 324 is of a rectangular shape as viewed in plan and has a pair of opposite sides projecting arcuately outwardly.

The antenna assembly 303 has a hollow cylindrical bobbin 326 integral with an outer edge of the terminal support 324 and a coil antenna 328 comprising a wire coil disposed on an outer circumferential surface of the bobbin 326 for wireless power feeding. The bobbin 326 is disposed on the reverse side of the circuit board 304. The coil antenna 328 is electrically connected to the circuit board 304 disposed on a front end face of the bobbin 326 and is disposed coaxially with the control button 318. The coil antenna 328 has an outside diameter which is essentially the same as the outside diameter of the control button 318.

The circuit board 304 is of a rectangular shape as viewed in plan and has a pair of opposite sides projecting arcuately outwardly and a pair of opposite cut-off corners. The circuit board 304 is disposed in the holder case 308 such that it has a mounting surface faces forwardly. The circuit board 304 has a plurality of insertion holes 330 defined therein for receiving the terminals 40 inserted therein. The terminals 40 are inserted from the rear side of the circuit board 304 through the respective insertion holes 330 and soldered to the circuit board 304 from the front side of the circuit board 304, so that the terminals 40 are electrically connected to the circuit board 304.

The circuit board 304 has on its front surface (mounting surface) a plurality of light-emitting elements 86, 88, 90, 92, 94 for emitting light forwardly and a pair of fixed contacts 96, 98. The light-emitting elements 86, 88, 90, 92, 94 are arrayed in line along one direction. The fixed contacts 96, 98 are positioned on a diagonal line across the circuit board 304.

The cover 306 comprises an integrally molded member of a resin material such as rubber or the like. The cover 306 has a cover body 332 disposed over the front side of the circuit board 304, a plurality of housing tubes 102, 104, 106, 108, 110 mounted on the cover body 332 and housing the respective light-emitting elements 86, 88, 90, 92, 94 therein, and a pair of contact assemblies (rubber contact assemblies) 112, 114 disposed in alignment with the respective fixed contacts 96, 98. The cover body 332 is of a shape similar to the circuit board 304.

The holder case 308 comprises an integrally molded member of a resin material which is of a hollow cylindrical shape. The holder case 308 has teeth 334 on an outer surface thereof for mounting the holder case 308 (switch device 300) on an instrument panel, not shown.

The holder case 308 has a base support 336 (see FIG. 12) supporting the base 302 on a rear end portion of an inner circumferential surface thereof. The holder case 308 also has a plurality of (four in the second embodiment) slider supports 338, 340, 342, 344 on a front end portion of the inner circumferential surface thereof for supporting the slider 310 for sliding movement along the longitudinal directions thereof. The slider supports 338, 340, 342, 344 are spaced at given intervals along the circumferential directions of the holder case 308. The slider supports 338, 340, 342, 344 have respective guide grooves 343 extending along the axial directions of the holder case 308 for guiding the slider 310, and respective stoppers (a movement limiter) 345 for limiting the slider 310 against rearward movement.

The holder case 308 has a pair of holes 346, 348 defined in a front end portion thereof for supporting the control button 318 for movement along the longitudinal directions. The holder case 308 has on a front end portion of an outer circumferential surfaced thereof a positioning tooth 350 for positioning the outer case 322 in a given position on the holder case 308, and a pair of mounting teeth 352, 354 for mounting the outer case 322 on the holder case 308.

The slider 310 comprises an integrally molded member of a resin material or the like. The slider 310 has a first holder 356 for holding the first light guide 312, a second holder 358 for holding the second light guide 314, a pair of third holders 360, 362 for holding the third light guide 316, and a pair of pressers 363, 364 for pressing the contact assemblies 112, 114. As shown in FIG. 11, the first holder 356, the second holder 358, and the third holders 360, 362 are held in engagement with each other. The first holder 356 and the second holder 358, each substantially in the form of a rectangular ring, are spaced apart from each other by a predetermined distance.

The third holders 360, 362, each of an arcuate shape, are disposed in sandwiching relation to the first holder 356 and the second holder 358. The third holders 360, 362 are spaced apart from each of the first holder 356 and the second holder 358 by predetermined distances.

The third holder 360 has a pair of rails 366, 368 disposed respectively in the guide grooves 343 in the respective slider supports 338, 340, and a mounting tooth 370 for mounting the control button 318 on the slider 310. The third holder 362 has a pair of rails 372, 374 disposed respectively in the guide grooves 343 in the respective slider supports 342, 344, and a mounting tooth 376 for mounting the control button 318 on the slider 310. The rails 366, 368, 372, 374 extend along the longitudinal directions. The slider 310 is circumferentially positioned with respect to the holder case 308 by the rails 366, 368, 372, 374 that are disposed in the respective guide grooves 343 in the slider supports 338, 340, 342, 344.

The first light guide 312, which is in the form of a substantially rectangular plate, is disposed in an inner hole defined in the first holder 356 for guiding light emitted from the light-emitting element 88 to the control button 318. The second light guide 314, which is in the form of a substantially rectangular plate, is disposed in an inner hole defined in the second holder 358 for guiding light emitted from the light-emitting element 92 to the control button 318.

The third light guide 316, which is in the form of a circular plate, has a hole 378 defined in a central area thereof for receiving the first holder 356 disposed therein and a hole 380 defined in the central area thereof for receiving the second holder 358 disposed therein. Specifically, the third light guide 316 includes a central light guide 382 disposed between the holes 378, 380, i.e., the first holder 356 and the second holder 358, and an outer circumferential light guide 384 disposed around the holes 378, 380, i.e., the first holder 356 and the second holder 358. The central light guide 382 serves to guide light emitted from the light-emitting element 90 to the control button 318, and the outer circumferential light guide 384 serves to guide light emitted from the light-emitting elements 86, 94 to the control button 318.

The control button 318 has a presser 386 in the form of a circular plate, an extension 388 projecting radially outwardly from a rear end of the presser 386, and a pair of walls 390, 392 extending rearwardly from a circumferential edge of the extension 388. The presser 386 has a front surface marked with letters "START", "ENGINE", "STOP".

The wall 390 has a mounting hole 394 defined therein for receiving the mounting tooth 370 of the slider 310 fitted therein and a tooth 396 for being inserted in the hole 346 defined in the holder case 308. The wall 392 has a mounting hole 398 defined therein for receiving the mounting tooth 376 of the slider 310 fitted therein and a tooth 400 for being inserted in the hole 348 defined in the holder case 308. The control button 318 is limited against movement along the longitudinal directions by the teeth 396, 400 that are inserted respectively in the holes 346, 348 in the holder case 308.

The outer case 322 has a hollow cylindrical circumferential wall 402 and an annular stopper flange 404 disposed on a front end of the circumferential wall 402. The circumferential wall 402 has a rear end portion having a slot 406 defined therein for receiving the positioning tooth 350 of the holder case 308 inserted therein, and a pair of mounting holes 408, 410 for receiving the mounting teeth 352, 354 of the holder case 308 fitted respectively therein.

When the portable device carried by the driver of the vehicle and the vehicle communicate with each other and their ID information agrees with each other, the driver presses the control button 318 of the switch device 300. The slider 310 moves rearwardly with respect to the holder case 308, causing the pressers 363, 364 of the slider 310 to press the contact assemblies 112, 114. The circuit board 304 of the switch device 300 now supplies a signal to the controller (ECU) of the vehicle, making the engine ready to start.

At this time, the rails 366, 368, 372, 374 of the slider 310 are held in contact with the stoppers 345 of the slider supports 338, 340, 342, 344. Consequently, even if the pressing force applied by the control button 318 is relatively large, excessive forces are prevented from being applied to the contact assemblies 112, 114, so that the circuit board 304 is protected against undue damage.

When the engine is ready to start, all or some of the light-emitting elements 86, 88, 90, 92, 94 emit light. According to the second embodiment, however, the light-emitting elements 86, 88, 90, 92, 94 may be energized to emit light when the engine is not ready to start.

The light emitted from the light-emitting element 88 passes through the first light guide 312 and illuminates the letters "START" on the control button 318. The light emitted from the light-emitting element 90 passes through the central light guide 382 and illuminates the letters "ENGINE" on the control button 318. The light emitted from the light-emitting element 92 passes through the second light guide 314 and illuminates the letters "STOP" on the control button 318. The light emitted from the light-emitting elements 86, 94 passes through the outer circumferential light guide 384 and is guided thereby to the control button 318, illuminating the control button 318 in a ring pattern, which is effective to increase the aesthetic appearance and visibility of the control button 318.

When the driver subsequently releases the control button 318, the contact assemblies 112, 114 spring back to their original shape. Under the elastic forces of the contact assemblies 112, 114, the slider 310 is moved forwardly with respect to the holder case 308, displacing the extension 388 of the control button 318 into contact with the stopper flange 404 of the outer case 322.

If the portable device fails to check the ID information against the vehicle due to a cell power failure, then the driver may hold the portable device in front of the control button 318 in the vicinity thereof, so that a radio wave emitted from the coil antenna 328 can perform wireless power feeding on the portable device.

The second embodiment offers the same advantages as the first embodiment described above. In addition, since the bobbin 326 is disposed on the reverse side of the circuit board 304, the distance between the coil antenna 328 and the circuit board 304 is relatively short, thereby simplifying the structure of the antenna assembly 303 and making it easy to assemble the antenna assembly 303.

Inasmuch as the coil antenna 328 is disposed behind the circuit board 304, the distance between the control button 318 and the circuit board 304 is shorter and the slider 310 and the first through third light guides 312, 314, 316 are smaller in size than if the coil antenna 328 is disposed between the control button 318 and the circuit board 304. Therefore, the switch device 300 with the coil antenna 328 disposed in a front region thereof is made small in size along the longitudinal directions thereof.

While the preferred embodiments of the present invention have been described above, it should be understood that the present invention is not limited to the illustrated embodiments, but various changes and modifications may be made to the embodiments without departing from the scope of the appended claims.

What is claimed is:

1. A switch device comprising:

a tubular case;

a circuit board disposed in the case;

a control button disposed for movement along longitudinal directions of the case, the control button being actuated by pressing from outside of the switch device;

a switch unit mounted on the circuit board, the switch unit being actuated in response to rearward movement of the control button by pressing; and a coil antenna electrically connected to the circuit board, for emitting a radio wave for energizing an external portable device;

wherein a front end of the coil antenna is positioned rearwardly of a rear end of the control button, the control button and the coil antenna are disposed coaxially with each other, and the control button has a largest outside diameter which is same as an outside diameter of the coil antenna.

2. The switch device according to claim 1, further comprising:

a slider disposed in the case for sliding movement along the longitudinal directions while allowing the switch unit to be actuated, the control button being disposed on a front end of the slider.

3. The switch device according to claim 2, wherein the circuit board has a mounting surface facing forwardly; and the switch unit has a contact assembly disposed on the mounting surface, the contact assembly being elastically deformable.

4. The switch device according to claim 3, wherein the case has a movement limiter for limiting the slider against rearward movement upon contacting a rear end of the slider.

5. The switch device according to claim 3, further comprising:

an antenna assembly having the coil antenna and a bobbin supporting the coil antenna and disposed on a front surface of the circuit board.

6. The switch device according to claim 3, further comprising a supporting member which contacts a rear surface of the circuit to support the circuit board, wherein the switch unit has a fixed contact disposed on the mounting surface of the circuit board to make contact with the contact assembly, and the fixed contact is positioned in front of the supporting member.

7. The switch device according to claim 3, further comprising:

a plurality of light-emitting elements mounted on the mounting surface of the circuit board, for illuminating the control button.

8. The switch device according to claim 7, wherein the slider has a plurality of light guides for guiding light emitted from the light-emitting elements to the control button.

9. The switch device according to claim 1, further comprising:

an antenna assembly having the coil antenna and a bobbin supporting the coil antenna and disposed on a reverse side of the circuit board.

10. The switch device according to claim 9, further comprising:

a slider disposed in the case for sliding movement along the longitudinal directions while allowing the switch unit to be actuated, the control button being disposed on a front end of the slider;

wherein the circuit board has a mounting surface facing forwardly, the switch unit being mounted on the mounting surface; and the coil antenna is disposed rearwardly of the circuit board.

* * * * *